United States Patent [19]

Yamada

[11] Patent Number: 5,038,575

[45] Date of Patent: Aug. 13, 1991

[54] REFRIGERATOR WITH DEFROST OVERRIDE SYSTEM

[75] Inventor: Tetsuro Yamada, Ibaraki, Japan

[73] Assignee: Kabushiki Kaisha Toshiba, Kawasaki, Japan

[21] Appl. No.: 518,291

[22] Filed: May 4, 1990

Related U.S. Application Data

[63] Continuation of Ser. No. 327,435, Mar. 23, 1984, abandoned, which is a continuation of Ser. No. 106,519, Oct. 9, 1987, abandoned.

[30] Foreign Application Priority Data

Feb. 14, 1987 [JP] Japan ..... 62-32189

[51] Int. Cl.[5] ..... F25D 21/08

[52] U.S. Cl. ..... 62/234; 62/128; 62/155; 62/156; 62/276

[58] Field of Search ..... 62/155, 156, 140, 128, 62/127, 126, 129, 234, 275, 276

[56] References Cited

U.S. PATENT DOCUMENTS 3,188,828 6/1965 Wayne ..... 62/275 X
3,890,798 6/1975 Fujimoto et al. ..... 62/156 X
4,299,095 11/1981 Cassarino ..... 62/155
4,344,294 8/1982 Gelbard ..... 62/155
4,665,710 5/1987 Kyzer et al. ..... 62/156 X

FOREIGN PATENT DOCUMENTS 52-37882 8/1977 Japan .

*Primary Examiner*—Harry B. Tanner
*Attorney, Agent, or Firm*—Cushman, Darby & Cushman

[57] ABSTRACT

A refrigerator having an enclosed compartment for storing food to be cooled, an evaporator including a refrigerant flowing therethrough for cooling the food in the compartment, a defrosting device, and a defrost override device. The defrosting device periodically heats the evaporator for removing the accumulated frost for controlled periods. The defrost override device automatically deactivates the defrosting device when the heating of the evaporator continues for longer than a preset time. The defrost override device may also automatically activate the refrigerant flowing through the evaporator. In this manner the refrigerator of this invention can store food without overheating during the defrosting operation.

8 Claims, 3 Drawing Sheets

REFRIGERATOR WITH DEFROST OVERRIDE SYSTEM

This is a continuation of Application No. 07/327,435, filed on Mar. 23, 1989, which was abandoned upon the filing hereof which in turn is a continuation of 07/106,519 filed Oct. 9, 1987, now abandoned.

BACKGROUND OF THE INVENTION

1. Field of the invention

The present invention relates, in general, to refrigerators.

More particularly, the invention relates to a refrigerator with a defrost override system for automatically deactivating the defrost device in response to heating of the evaporator for longer than a preset time.

2. Description of the Prior Art

As is well known, a refrigerator typically is provided with a defrosting system for removing the frost accumulated on the evaporator. A defrosting system of such a well known refrigerator normally includes a defrost timer for counting the cumulative running time of the compressor in order to start the defrosting operation, a defrost heater for thawing the frost accumulated on the evaporator and a defrost sensor for detecting the temperature of the evaporator in order to stop the defrosting operation.

The defrosting operation is controlled and carried out periodically by a microcomputer of a control circuit. When the cumulative compressors running time counted by the defrost timer reaches a prescribed level, such as, e.g., thirteen hours, the compressor is prevented from operating, and the defrost heater is activated. While the defrost heater is on, the frost on the evaporator is gradually thawed by radiant heat from the defrost heater, and in accordance with the thawing of the frost, the temperature of the evaporator gradually rises. In this period, the defrost sensor detects the temperature of the evaporator. When the temperature of the evaporator detected by the defrost sensor reaches a prescribed value, such as, e.g., 13 ° C. the defrost heater is deenergized, and the compressor is returned to an operational state.

As is evident, it is the most important function of a refrigerator to maintain the temperature of the food stored therein at an appropriate level such as, e.g. —18° C. Even during the defrosting operation, it is necessary to maintain the temperature of the food below the prescribed level. However this defrosting system of the conventional refrigerator, when the defrost sensor experiences some defect, such as. e.g., shorting or breaking, the defrost operation does not stop. This is because the defrost sensor cannot detect when the temperature of the evaporator heated by the defrost heater has reached the prescribed upper limit value, as described above. Therefore, the defrost heater continues to operate, the compressor operation continues to be prevented, and the temperature of the food continues to rise higher and higher until a thermal fuse in the control circuit opens to prevent the refrigerator from catching fire.

Also when the defrost heater has some defect, such as, e.g.,a broken wire or glass, the defrost operation may not stop. This is because the defrost heater cannot generate radiant heat to thaw the frost on the evaporator, and the temperature of the evaporator does not reach the prescribed value described above. Therefore, the compressor continues to be interrupted, and the temperature of food continues to rise higher and higher until the temperature of the evaporator naturally, without being heated by the defrost heater, reaches the prescribed value, such as, e.g., 13° C.

Particularly in winter, the compressor operation is interrupted almost continuously because the temperature of the evaporator practically never reaches the prescribed value, as described above, As a result, food such as ice cream may be melted, and in the worst condition, food such as eggs may rot.

In order to solve the problem mentioned above, a defrost warning system has been developed for informing a user that there is some defect in the defrosting operation. An example of such a defrost warning system is disclosed in Japanese Utility Model Publication No. 52-37882, filed on Sept. 26, 1975 in the name of Minoru Igarashi, etc. In Japanese Utility Model Publication No. 37882, a warning timer for(counting the defrost time is provided with the control circuit. When the count of the warning timer reaches a prescribed value before the completion of the defrosting operation, an audible warning is given to the user of the refrigerator. By this warning the user is made aware that the defrosting operation was not carried out correctly, and the user can manually stop the defrosting operation. However even with this prior art system, the defrosting operation could be continued for an extraordinarily long time, and the temperature of the food could rise to such a high degree that the food is melted or turns rotten.

The prior art system is based on the idea that the user will manually stop the defrosting operation. Therefore, when in spite of the warning the user of the refrigerator is unaware that the defrosting operation is wrong, such as, e.g., when the user is not within hearing distance of the warning system the prior art system does not prevent overheating of the refrigerator. Accordingly, because the warning may be generated in vain, and since the defrosting operation may not be stopped by a user, the defrosting operation can continue t ©be carried out for an extraordinarily long time, and the temperature of the food may rise to an extraordinarily high degree.

SUMMARY OF THE INVENTION

It is an object of the present invention to prevent food stored in a refrigerator from being overheated during a defrosting operation.

To accomplish the object described above, the present invention provides a refrigerator with a defrost override system. The refrigerator comprises an enclosed compartment for storing items to be cooled, an evaporator device including a refrigerant flowing therethrough, a defrosting device, and an override device. The evaporator device removes heat from the compartment and is subject to accumulation of frost thereon. The defrosting device periodically has the evaporator device for controlled periods in order to remove the accumulated frost and is subject to uncontrolled heating at times other than during the controlled periods. The override device automatically deactivates the defrosting device in response to heating of the evaporator&or device for longer than a preset time.

BRIEF DESCRIPTION OF THE DRAWINGS

The present invention is best understood with reference to the accompanying drawings in which.

DETAILED DESCRIPTION OF THE PREFERRED EMBODIMENT

Referring to the accompanying drawings, an embodiment of the present invention will be described.

Figure 1:
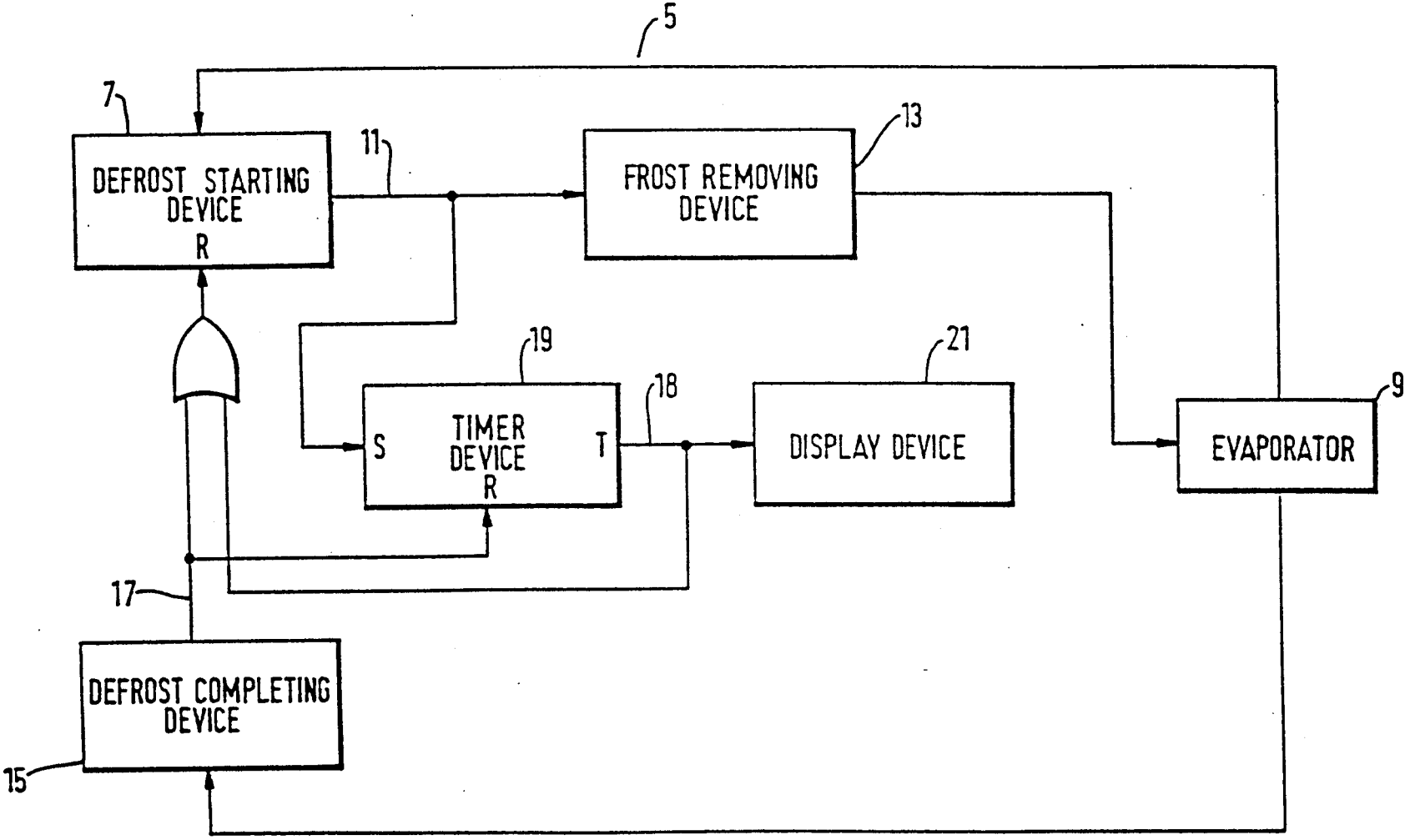
FIG. 1 is a schematic block diagram illustrating a defrosting system of an embodiment of the present invention.

As is illustrated in FIG. 1 the defrosting system 5 includes a defrost starting device 7 for detecting the amount of frost accumulated on an evaporator 9 and generating a defrost starting signal 11 when the amount of frost on the evaporator 9 reaches a prescribed level. A frost removing device 13 thaws the frost on the evaporator 9 in accordance with the defrost starting signal 11. A defrost completing device 15 detects the amount of the frost removed by the frost removing device 13 and generates a defrost completing signal 17 when the amount of the removed frost reaches a prescribed level. A timer device 19 counts the time of the defrost operation in accordance with the defrost starting signal 11 and generates an error signal 18 when the count reaches a prescribed level A display device 21 is provided for indicating an error message that there has been some defect in the defrosting system 5 in response to the error signal 18. The timer device 18 is reset by the defrost completing signal 15 to cut-off the error signal 18. The defrost starting device 7 is then reset by either of the defrost completing signal 17 or the error signal 18 to cut off the defrost starting signal 11.

If the defrosting system 5 has no defect, in accordance with the defrost starting signal 11 from the defrost starting device 7, the frost removing device 13 is activated to thaw the frost accumulated on the evaporator 9, and simultaneously, the timer device 19 starts to count. Before the count of the timer 19 reaches the prescribed value, which is e.g., three hours, the defrost completing signal 17 is generated from the defrost completing device 15. In response to ±his defrost completing signal 17, the defrost starting device 7 is reset cease generating of the defrost starting signal 11, and the timer device 19 is also reset. Therefore, the error signal 18 is not generated by the timer device, and the error message is not displayed on the display device 21. In this case the defrost operation has been normally carried out.

If the defrost system 5 has some defect, for example, if the defrost completing device 15 is out of order, the defrost completing signal is is not properly generated because the defrost completing device 15 cannot accurately detect the amount of the frost removed by the frost removing device 13. Therefore, the timer device 19 is not reset by the defrost completing signal 17 before the count of the timer device 19 reaches the prescribed level, such as three hours, and the error signal 18 is generated. By this error signal 18 from the timer device 19, the defrost starting device is forcibly reset to cease generating the defrost starting signal 11 and the error message remains displayed on the display device 21.

As a further example, if the frost removing device 13 is damaged, the frost on the evaporator 9 may not be thawed out in spite of the defrost starting signal 11. The timer device 19 is thus not reset by the defrost completing signal 17 before the count of the timer device 19 reaches the prescribed level, such as three hours, because the defrost completing signal 17 is never generated. Therefore, also in this case, the error signal 18 is generated from the timer device 19, the defrost starting device 7 is forcibly reset to cease generating the defrost starting signal 11 by the error signal 18, and the error message is kept displayed on the display device 21.

Figure 2:
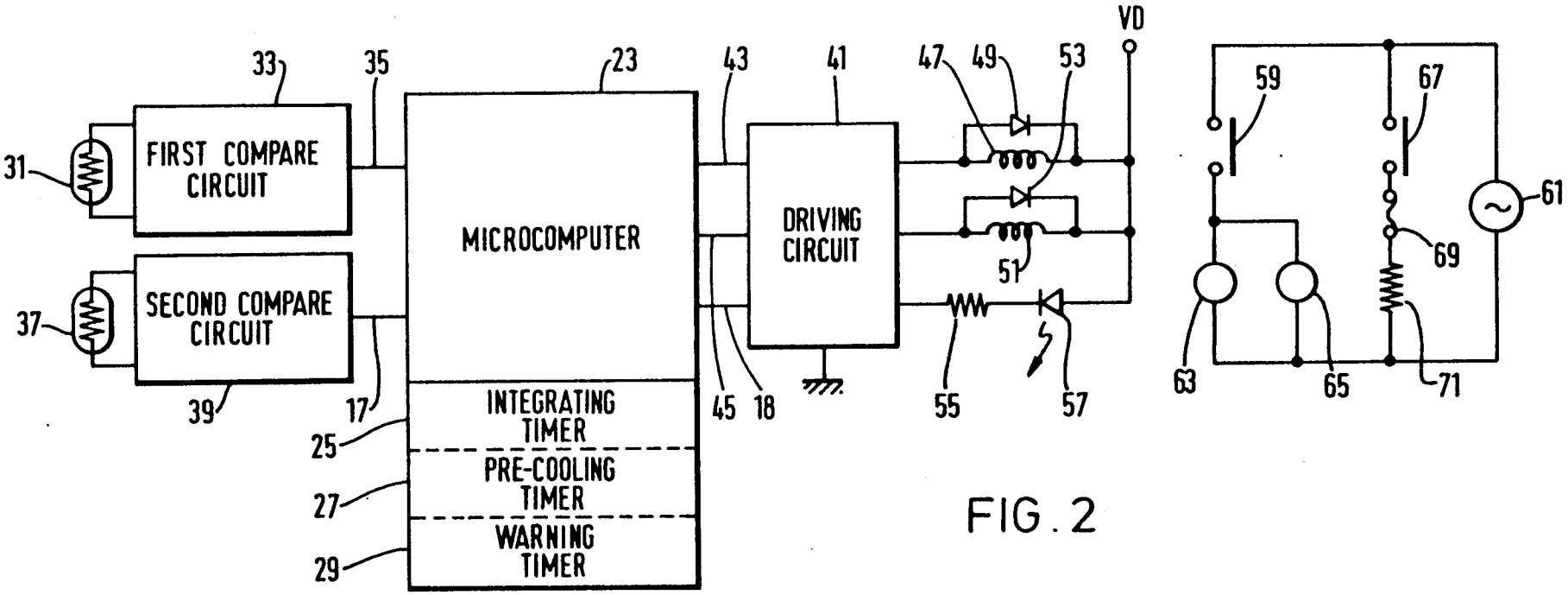
FIG. 2 is a schematic circuit diagram illustrating a defrost control circuit of the embodiment of the present invention.

As is shown in FIG. 2, a defrost control circuit of the refrigerator includes a microcomputer 23 for controlling operation of the refrigerator, such as the defrosting operation, a normal cooling operation and so on. The microcomputer 23 includes a CPU (Central Processing Unit), ROM (Read Only Memory), RAM (Random Access Memory), and input and output Ports (not shown). An integrating timer 25, a pre-cooling timer 27, and a warning timer 29 are also included in the microcomputer 23. A freezer sensor 31 is connected with the input port of the microcomputer 23 through a first compare circuit 33. The freezer sensor 31 is a negative characteristic thermistor, and by, being mounted in a freezer chamber of the refrigerator, detects the temperature of the freezer chamber. The first compare circuit 33 compares the freezer temperature detected by the freezer sensor 31 with a prescribed value, such as, e.g., −18° C., and when the detected freezer temperature becomes higher than the prescribed value, first compare circuit 33 applies an H-level cooling signal 35 in one bit to the input port of the microcomputer 23.

A defrost sensor 37 is connected with the input port of the microcomputer 23 through a second compare circuit 39. The defrost sensor 37 is also a negative characteristic thermistor, and by being attached on the evaporator 9, detects the temperature of the evaporator 9. The second compare compares the detected temperature of the evaporator 9 with a prescribed value, such as, e.g., 13° C., and when the temperature of the evaporator detected by the defrost sensor 37 becomes higher than the prescribed value, second compare circuit 39 applies an H-level defrost completing signal 17 in one bit to the input port of the microcomputer 23.

A driving circuit 41 comprising transistor arrays is connected with the output ports of the microcomputer 23. Each of a compressor driving signal 43, a defrost heater exciting signal 45, and the error signal 18 output from the output ports of the microcomputer 23 is applied to bases of three non transistors in the driving circuit 41, respectively. The emitters these three transistors are grounded. A collector of the first transistor, the base of which receives the compressor driving signal 43 is connected to a D.C. power source $V_D$ through a parallel circuit of a coil 47 of a first relay and a first diode 49. A collector of the second transistor, the base of which receives the defrost heater exciting signal 45, is connected to the D.C. power source $V_D$ through a parallel circuit of a coil 51 of a of a second relay and a second diode 53. A collector of the third transistor, the base of which receives the error signal 18, is connected to the D.C. power source $V_D$ through a series circuit of a resistor 55 and a light-emitting diode (LED) 57.

A normally open contact 59 of the first relay, which is closed when the coil 47 is excited, is connected to an A.C. power source 61 through the circuit employing a compressor motor 63 and a fan motor 65 in parallel. A normally open contact 67 of the second relay, which is closed when the coil 51 is excited, is connected to the A.C. power source 61 through the circuit employing a thermal fuse 69 and the defrost heater 71 in series.

Figure 3:
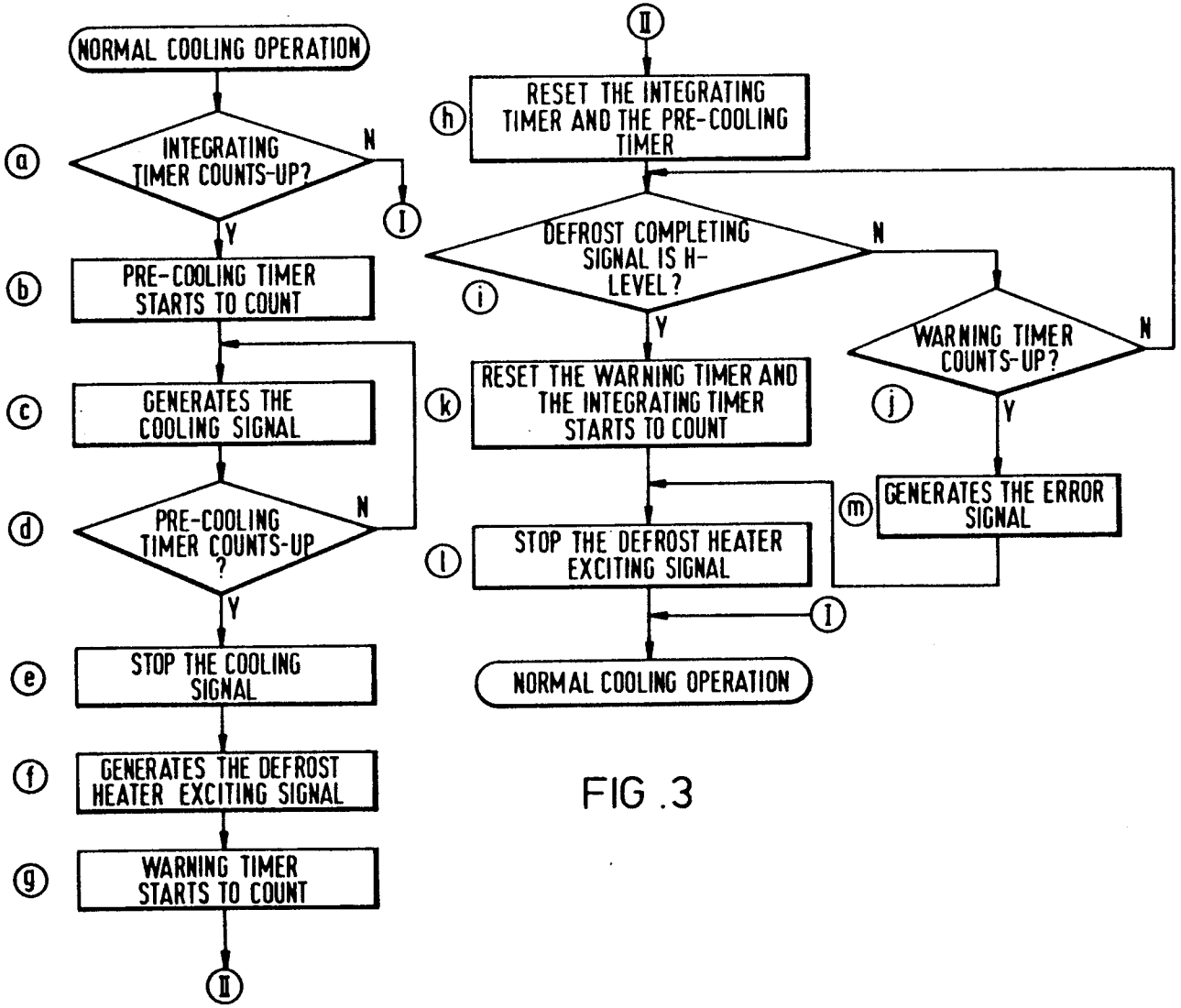
FIG. 3 is a flow chart explaining the operation of the microcomputer of FIG. 2.

The operation of the refrigerator controlled by the microcomputer 23 will be described with reference to FIG. 3. Firstly, in a normal cooling operation, the compressor motor 63 and the fan mo&or 65 are driven in accordance with the temperature detected by the freezer sensor 31, in other words, in accordance with the H-level cooling signal 35. The integrating timer 25 of the microcomputer 23 counts the time when the H-level cooling signal 35 is applied to the input port. This is equal to the operation time of the compressor and the fan as counted by the integrating timer 25 of the microcomputer 23.

In step a, if the counting of the integrating timer 25 reaches a prescribed data value stored in the ROM of the microcomputer 23, such as thirteen hours the YES-path is taken. Otherwise, the NO-path is taken. When the YES-path is taken, the microcomputer 23 determines that a defrosting operation is required, and executes the step b. When the NO-path is taken, the microcomputer 23 executes the normal cooling operation as described above.

In step b, the pre-cooling timer 27 of the microcomputer 23 starts to count for a pre-cooling operation. The pre-cooling operation aims at cooling the food in the compartment, especially in the freezer, to such an extent that the temperature of the food hardly rises during the defrosting operation, for example to −40° C.

In step c, for the pre-cooling operation the microcomputer 23 provides the compressor driving signal 43 to the driving circuit 41. In this state, the coil 47 of the first relay is excited through the driving circuit 41 and the normally open contact 59 of the first relay is closed. Therefore, the compressor motor 63 and the fan motor 65 are forcibly driven.

In step d, if the counting of the pre-cooling timer 27 reaches a prescribed data value stored in the ROM of the microcomputer 23, such as thirty two minutes, the YES-path is taken. Otherwise, the NO-path is taken. When the YES-path is taken, the microcomputer 23 determines the completion of the pre-cooling operation, and executes step e. When the NO-path is taken, the microcomputer 23 repeatedly executes the steps from c to d until the counting of the pre-cooling timer 27 reaches the prescribed level.

In step e, the microcomputer 23 stops providing the compressors driving signal 43 to the driving circuit 41. The coil 47 of the first relay is deenergized, and the normally open contact of the first relay becomes open. Therefore, the compressor motor 63 and the fan motor 65 are stopped, and the pre-cooling operation is completed.

In step f, the microcomputer 23 provides the defrost heater exciting signal 45 to the driving circuit 41. In this stage, through the driving circuit 41, the coil 51 of the second relay is excited and the normally open contact 67 of the second relay is closed. Therefore, the defrost heater 71 is excited, and the frost accumulated on the evaporator 9 is thawed by the radiation of the defrost heater 71.

In step g, the warning timer 29 of the microcomputer 23 starts to count the exciting time of the defrost heater 71 and continues to count until it is reset.

In step h, the integrating timer 25 and the pre-cooling timer 27 of the microcomputer 23 are reset.

In step i, if the defrost completing signal 17 provided from the defrost sensor 37 through ±he second compare circuit is of a H-level, the YES-path is taken. Otherwise, the NO-path is taken. In this stage, the microcomputer 23 determines whether the frost On the evaporator 9 is completely removed or not. When the NO-path is taken, the microcomputer 23 executes the step j.

In step j, if the count of the warning timer 29 driven in the step g reaches a prescribed value, such as three hours, the YES-path is taken. Otherwise, the NO-path is taken. When the NO-path is taken, the microcomputer 23 repeatedly executes the steps from i to j until the frost on the evaporator 9 is completely removed.

In case there are no defects in the defrosting system, within twenty minutes to one hour, the temperature of the evaporator 9 detected by the defrost sensor 37 usually reaches the prescribed value, such as 13° C. Therefore, the H-level defrost-completing signal 17 is provided into tho input port of the microcomputer 23 before the count of the warning timer 29 reaches the prescribed value, such as thirty two minutes. Thus, in step i, finally the YES-path is taken. When the YES-path is taken in step i, the microcomputer 23 executes the step k.

In step k, the warning timer 29 of the microcomputer 23 is reset, and the integrating timer 25 of the microcomputer 23 starts to be driven in order to count the operation time of the compressor motor 63 and the fan motor 65.

In step 1, the microcomputer 23 determines the completion of the defrosting operation and stops providing the defrost heater exciting signal 45. In this stage, the coil 51 of the second relay is deenergized, and the normally open contact 67 of the second relay becomes open. Therefore, the defrost heater is deenergized and the microcomputer 23 returns the operation of the refrigerator from the defrosting operation to the normal cooling operation.

There may be some defect in the defrosting system, for example, the defrost sensor 37 or the second compare circuit 39 may be out of order. In this case, in spite of the defrost heater being activated, the defrost sensor 37 or the second compare circuit 39 cannot detect that the temperature of the evaporator 9 reaches the prescribed value, such as 13 ° C. Therefore, the defrost completing signal 17 does not reach its H-level within twenty minutes to one hour As a result, the count of the warning timer 29 of the microcomputer 23 reaches the prescribed value, such as three hours before the H-level defrost completing signal 17 is provided to the input port of the microcomputer 23. Accordingly, in step j, finally the YES-path is taken. When the YES-path is taken in step j, the microcomputer 23 executes the step m. In step m. &he microcomputer 23 provides the error signal 18 to the driving circuit 41. In this stage, in accordance with this error signal 18, the third transistor of the driving circuit 41 turns on, and a D.C. current flows in the series circuit of the LED 57 and the resistor 55. Therefore, the LED 57 is energized with this D.C. current and the error message is displayed.

After executing the step m, the microcomputer 23 jumps to the step 1, and executes the step 1. In this step 1, the defrost heater exciting signal 45 is forcibly stopped and the defrost heater 71 is forcibly deenergized. Therefore, during the defrosting operation, the temperature in the refrigerator never rises to such a high degree that the stored food is melted or spoiled.

After executing the step 1, the microcomputer 23 returns the operation of the refrigerator from the defrosting operation to the normal cooling operation. However, since there were defects in the defrosting system, the defrost heater 71 is not energized anymore, for without executing the step k, the integrating timer 25 of the microcomputer 23 is kept reset.

As another example ,in case the d ®frost heater 71 is damaged, in spite of the defrost heater exciting signal 45 provided from the microcomputer 23, the defrost heater 71 does not generate radiant heat, and the temperature of the evaporator 9 detected by the defrost sensor 37 does not reach the prescribed value within twenty minutes to one hour. Therefore, the count of the warning timer 29 reaches the prescribed value ,such as three hours, before the H-level defrost completing signal 17 is provided to the input port of the microcomputer 23. Thus, also in this other example in step j the YES-path is taken, in step m the error message is displayed , and in step 1 the defrosting operation is forcibly completed. Then, the operation of the refrigerator is forcibly r ®turned to the normal cooling operation.

As can be understood from the above-described embodiment, any defect in the defrosting system can be detected by the microcomputer controlling the operation of the refrigerator, and if there is some defect in the defrosting system, the defrosting operation is forcibly deactivated and the operation of the refrigerator is automatically returned to the normal cooling operation. Moreover, the error message is displayed on the display device ,such an an LED. on a control substrate. Therefore, even when the defrosting system has some defect, but the user of the refrigerator is not aware of the defect of the defrosting system, the temperature of the food can be prevented from rising to an extraordinary degree during the defrosting operation. Moreover, because the error message is kept displayed until it is repaired, a service-man can easily find that the defect to be repaired is in the defrosting system and can repair the refrigerator more quickly.

The present invention has been described with respect to a specific embodiment. However, other embodiments based on the principles of the present invention such as, e.g. , employing a transmissional photodetector instead of the thermal sensor as the defrost sensor, should be obvious to those of ordinary skill in the art Such embodiments are intended to be covered by the claims.

What is claimed is:

1. A refrigerant, comprising:

an enclosed compartment for storing items to be cooled;

evaporator means including a refrigerant flowing there-through for removing heat from the compartment, the evaporator means, being subject to accumulation of frost thereon at least during a normal cooling operation;

defrosting heater means for periodically heating the evaporator means while the evaporator means is halted, for controlled periods for removing the accumulated frost, the defrosting heater means being subject to uncontrolled heating at times other than during the controlled periods; and override means for automatically disabling the defrosting heater means and for automatically and immediately returning the evaporator means to said normal cooling operation when the evaporator means is heated for longer than a preset time, and for thereafter preventing further periodic heating until the cause of said heating exceeding the preset time is repaired.

2. A refrigerator according to claim 1, wherein the defrosting heater means includes:

defrost starting means for generating a defrost starting signal when the evaporator means has a predetermined amount of frost accumulated thereon which makes it difficult for the evaporator means to remove heat from the comprising:

frost removing means for heating the evaporator means in response to the defrost starting signal; and defrost completing means for generating a defrost completing signal for resetting the defrost starting means when the accumulated frost has been removed.

3. A refrigerator according to claim 2, wherein the override means includes timer means for counting the preset time in response to the defrost starting signal and generating an error signal to reset the defrost starting means in accordance with the counted time.

4. A refrigerator according to claim 3, wherein the override means also includes display means for displaying the error message in response to the error signal.

5. A refrigerator according to claim 3, wherein the defrost starting means includes frost detecting means for detecting the accumulated frost on the evaporator means.

6. A refrigerator according to claim 3, wherein the defrost starting means includes frost clock means for counting the cumulative operation time of the evaporator means.

7. A refrigerator according to claim 3, wherein the defrost completing means includes a thermal sensor in the evaporator means and a compare circuit for comparing the temperature of the evaporator means with a prescribed value.

8. A method for preventing food stored in a refrigerator from being overheated, the refrigerator including an evaporator subject to the accumulation of frost thereon, comprising the steps of:

periodically halting operation of the evaporator;

during at least a portion of said halting step, heating the evaporator for controlled periods in order to remove the accumulated frost;

counting the heating time of the evaporator;

automatically overriding the heating of the evaporator immediately when the count of the heating time reaches a preset time longer than the controlled periods and for thereafter preventing further heating steps until the cause of the count exceeding the preset time is repaired; and upon said override, immediately returning the evaporator to normal cooling operation.

* * * * *